US007120378B2

(12) United States Patent
Nomura et al.

(10) Patent No.: US 7,120,378 B2
(45) Date of Patent: Oct. 10, 2006

(54) IMAGE FORMING APPARATUS USING A LIQUID DEVELOPER IN WHICH CARRIER LIQUID BACKFLOW IS INHIBITED

(75) Inventors: Yuko Nomura, Kawasaki (JP); Hideki Nukada, Yokohama (JP); Noriko Yamamoto, Yokohama (JP); Yasushi Shinjo, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 97 days.

(21) Appl. No.: 10/951,640

(22) Filed: Sep. 29, 2004

(65) Prior Publication Data

US 2005/0220496 A1 Oct. 6, 2005

(30) Foreign Application Priority Data

Mar. 31, 2004 (JP) ..... 2004-103847

(51) Int. Cl.
*G03G 15/11* (2006.01)

(52) U.S. Cl. ..... 399/251

(58) Field of Classification Search ..... None
See application file for complete search history.

(56) References Cited

U.S. PATENT DOCUMENTS 4,286,039 A 8/1981 Landa et al.
5,978,630 A 11/1999 Chang et al.
6,529,700 B1 3/2003 Nukada et al.
6,650,857 B1 * 11/2003 Nukada et al. ..... 399/249
6,973,280 B1 * 12/2005 Nukada et al. ..... 399/251

* cited by examiner

*Primary Examiner*—Quana Grainger
(74) *Attorney, Agent, or Firm*—Oblon, Spivak, McClelland, Maier & Neustadt, P.C.

(57) ABSTRACT

An electrophotographic apparatus using a liquid developer of the present invention includes a photosensitive member which holds an electrostatic latent image, a plurality of developing unit which supply liquid developers including toner particles and carrier liquid to the photosensitive member to form a visible image, a visible image stabilizing unit which enhances adsorption among toners constituting the visible image on the photosensitive member and between the toners and the photosensitive member by an electric field, a drying unit which dries the visible image formed on the photosensitive member, a periphery of the visible image, or the carrier liquids included in the visible image by an air current, and a shielding unit which is disposed between the drying unit and the visible image stabilizing unit and which prevents deposits attached to the photosensitive member surface together with liquid droplets of the carrier liquid existing on the photosensitive member surface from reaching the visible image stabilizing mechanism.

10 Claims, 5 Drawing Sheets

IMAGE FORMING APPARATUS USING A LIQUID DEVELOPER IN WHICH CARRIER LIQUID BACKFLOW IS INHIBITED

CROSS-REFERENCE TO RELATED APPLICATIONS

This application is based upon and claims the benefit of priority from prior Japanese Patent Application No. 2004-103847, filed Mar. 31, 2004, the entire contents of which are incorporated herein by reference.

BACKGROUND OF THE INVENTION

1. Field of the Invention

The present invention relates to an electrophotographic apparatus using a liquid developer, a carrier liquid removal mechanism which removes a carrier liquid especially from an image before transfer, and an image forming method.

2. Description of the Related Art

An electrophotographic apparatus using a liquid developer has advantages which cannot be realized by a dry electrophotographic apparatus, and has been evaluated again in recent years. For example, major advantages of liquid process electrophotography in contrast to the dry process are as follows. Since an extremely fine toner having a submicron size is usable, high image quality can be realized. Since a sufficient image density is obtained by a small amount of toner, the apparatus is economical, and a quality equivalent to that of printing (e.g., offset printing) can be realized. Furthermore, since the toner can be fixed to a sheet at a comparatively low temperature, energy saving can be realized.

In the liquid process electrophotographic apparatus using a pressure transfer, it is necessary to remove an excess carrier liquid (solvent) from the inside and the vicinity of the visible image formed on a photosensitive member. For example, in Jpn. Pat. Appln. KOKAI Publication No. 2002-278302, a drying device has been proposed which has two or more nozzles capable of blowing air, along the surface of the photosensitive member and which blows the air onto the surface of the photosensitive member at a predetermined speed to thereby dry excess carrier liquid.

However, in the drying device proposed in the Jpn. Pat. Appln. KOKAI Publication No. 2002-278302, which blows the air along the surface of the photosensitive member to dry the excess carrier liquid, problems occur in many cases that the carrier liquid conveyed together along the surface of the photosensitive member drip and generate image dirt on output images or pollute other elements disposed around the photosensitive member and the inside of the apparatus.

BRIEF SUMMARY OF THE INVENTION

An object of the present invention is to prevent deterioration of an image and pollution inside of apparatus from being caused by the air for drying a visible image and removing a carrier liquid before transfer in an electrophotographic apparatus using a liquid developer.

An aspect of the present invention, an image forming apparatus comprising: a photosensitive member which holds an electrostatic latent image; a developing unit which supplies a liquid developer obtained by dispersing a toner in a carrier liquid to the electrostatic latent image to form a visible image on the photosensitive member; a transfer member onto which the visible image is transferred; an image stabilizing unit which applies an electric field to the visible image to enhance adsorption among the toners forming the visible image and between the toners and the photosensitive member; a drying unit which blows an air current to the visible image having the adsorption to the photosensitive member enhanced by the image stabilizing unit to dry and remove the carrier liquid; and a shielding member which is disposed between the drying unit and the image stabilizing unit and which inhibits liquid droplets of the carrier liquid flowing backwards toward the image stabilizing unit from the drying unit from reaching the image stabilizing unit.

Additional objects and advantages will be set forth in the description which follows, and in part will be obvious from the description, or may be learned by practice. The objects and advantages may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments, and together with the general description given above and the detailed description of the embodiments given below, serve to explain the principles.

DETAILED DESCRIPTION OF THE INVENTION

An embodiment will be described hereinafter with reference to the drawings.

Figure 1:
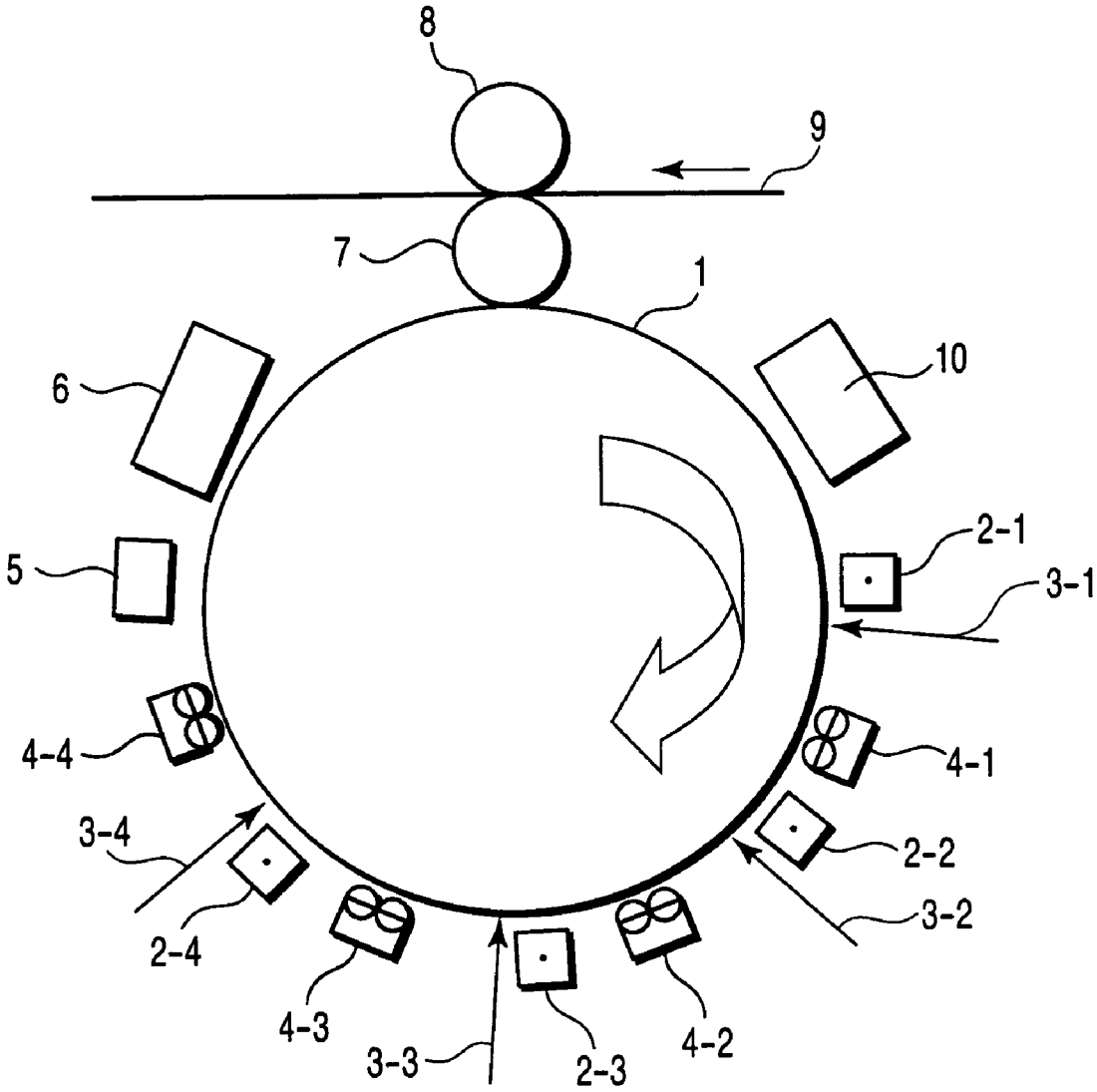
FIG. 1 is a schematic diagram showing one example of an electrophotographic apparatus using a liquid developer, to which an embodiment is applicable.

FIG. 1 shows one example of an electrophotographic apparatus using a liquid developer, to which the embodiment is applicable.

A photosensitive member 1 is a drum in which an organic or amorphous silicon photosensitive layer is disposed on a conductive substrate, for example, of aluminum. A mold-releasing layer is disposed on the photosensitive layer, and toner particles are preferably prevented from being fixed to the photosensitive layer. In FIG. 1, a roller-shaped photosensitive member is shown, but a sheet with a photosensitive layer may be fixed to a rigid drum. A rotatable photosensitive member may be adopted in which, an elastic belt is formed into an annular shape, and the photosensitive layer is formed on the surface of the belt.

After the photosensitive member 1 is uniformly charged by a charging unit 2-1 constituted of a known corona charger or scorotron charger, and thereafter an electrostatic latent image is formed on the surface of the member 1 by an expose unit 3-1 by an image-modulated laser beam or an LED array which is turned on/off in accordance with image data.

The electrostatic latent image formed on the photosensitive member 1 is developed and visualized by a developing unit 4-1 storing a liquid developer, toner particles as a mixture of a resin and colorant dispersed in the carrier liquid which is an insulating and nonpolar liquid.

Subsequently, the photosensitive member 1 is charged to a predetermined potential by a second charging device 2-2 again, and a second electrostatic latent image is formed by a second expose unit 3-2.

The second electrostatic latent image is developed by a second developing unit 4-2 which stores the second liquid developer containing a color different from that of the liquid developer stored in the first developing unit 4-1.

Thereafter, a third electrostatic latent image is formed by a third charging unit 2-3 and a third expose unit 3-3, and is developed by a third developing unit 4-3 which stores a third liquid developer having a color different from colors of the liquid developers stored in the first and second developing unit. Furthermore, a fourth electrostatic latent image is formed by a fourth charging unit 2-4 and a fourth expose unit 3-4, and is developed by a fourth developing unit 4-4 which stores a fourth liquid developer having a color different from colors of the liquid developers stored in the first to third developing unit.

Thereby, a four-color (full-color) visible image is formed on the photosensitive member 1.

A visible image stabilizing unit 5, such as a corona charger or a roller charger, provides electrostatic force on the visible image to enhance the rigidity of the visible image. Thereafter, the photosensitive layer moves by rotation of the photosensitive member 1, and accordingly the visible image is conveyed to a drying position facing a drying unit 6 for drying and removing the carrier liquid.

Figure 2:
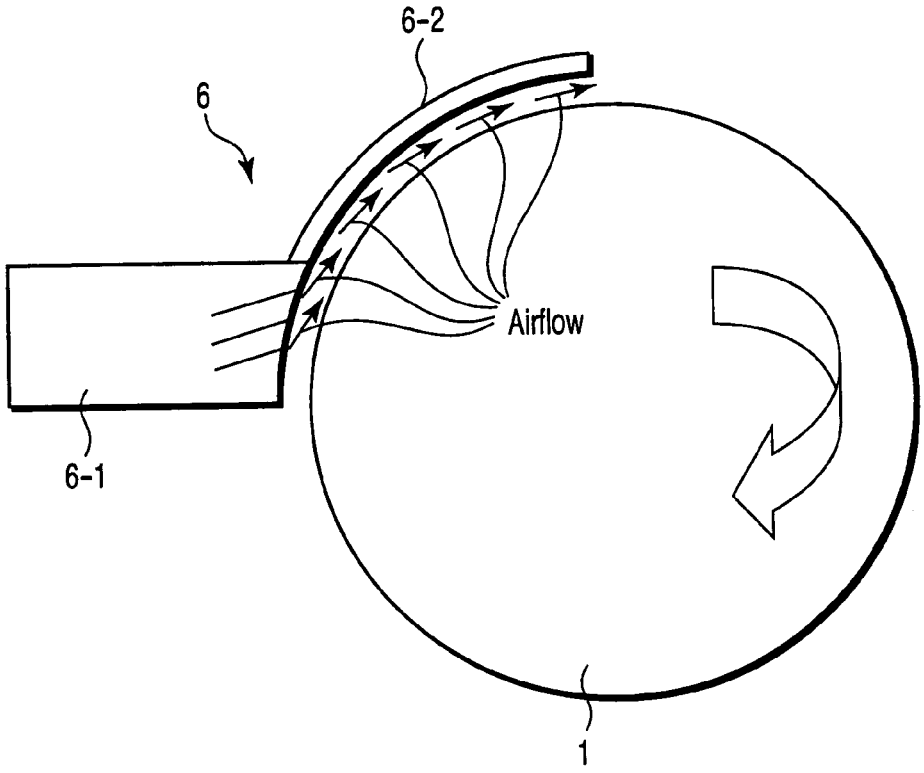
FIG. 2 is a schematic diagram showing one example of a drying device incorporated in the electrophotographic apparatus shown in FIG. 1.

For example, as shown in FIG. 2, the drying unit 6 has a nozzle (nozzle block) 6-1 which blows drying air supplied from a blower device (not shown) onto the photosensitive layer, that is, an outer peripheral surface of the photosensitive member 1. The nozzle 6-1 supplies the above-described air flowing along the surface of the photosensitive member 1 and flowing downstream from upstream on the basis of a direction in which the photosensitive member 1 is rotated. The nozzle (nozzle block) 6-1 includes, for example, two or more nozzles, and supplies the air at a speed, for example, of 80 to 120 m/sec toward an approximately 0.5 to 5 mm gap defined between a guide portion 6-2 and the outer peripheral surface of the photosensitive member 1.

After drying the carrier liquids on the visible image and the photosensitive member 1 by the drying unit 6, the visible image is transferred onto an intermediate transfer member 7. After the first transfer, the transfer for the intermediate transfer member 7, the visible image is transferred onto a sheet (output medium) 9 conveyed between an intermediate transfer member 7 and a pressurizing roller 8. In a transfer unit, the intermediate transfer member 7 is brought into contact with the pressurizing roller 8 at a predetermined pressure (in a state in which axial lines substantially extend in parallel). The visible image transfer from the intermediate transfer member 7 to the photosensitive member 1 is realized by pressure performed by bringing both the members into contact with each other at a predetermined contact pressure. The surface velocity V2 of the intermediate transfer member 7 is set to V2/V1=0.98, which is slightly slow with respect to the surface velocity V1 of the photosensitive member 1. Accordingly, a shear stress is added to the visible image, and the visible image is transferred onto the intermediate transfer member 7.

In the above-described pressure transfer system, when the visible image is transferred onto the intermediate transfer member 7 from the photosensitive member 1, excess carrier liquids remaining among the toners constituting the visible image and between the individual toners and the photosensitive member 1 need to be securely removed. This is because when the surface of the photosensitive member 1 is wet by the excess carrier liquids, the intermediate transfer member 7 is degraded; further a shearing force does not easily work, and transfer efficiency also drops. Therefore, in order to securely realize the pressure transfer, it is indispensable to remove the excess carrier liquid from the developed visible image before the transfer until a dried state can be substantially recognized.

A transfer residual toner remaining on the surface of the photosensitive member 1 is removed by a cleaner 10 disposed between the first charging unit 2-1 and the intermediate transfer member 7.

Between the drying unit 6 and the visible image stabilizing unit 5, a shielding member 11 is disposed which inhibits liquid dripping of the carrier liquid (dripping of the carrier liquid from the outer peripheral surface of the photosensitive member 1, hereinafter referred to as the liquid dripping) sometimes caused on the surface of the photosensitive member 1 from reaching the visible image stabilizing unit 5 (element positioned right under the drying unit 6).

When the liquid dripping, that is, a dropped carrier liquid reaches, for example, the visible image stabilizing unit 5, the liquid appears as image dirt such as image fogging on an output image together with the visible image on the photosensitive member 1 by an electric field force. Therefore, the liquid dripping (dropped toner liquid) should be inhibited from being left on at least the surface of the photosensitive member 1.

Figure 3:
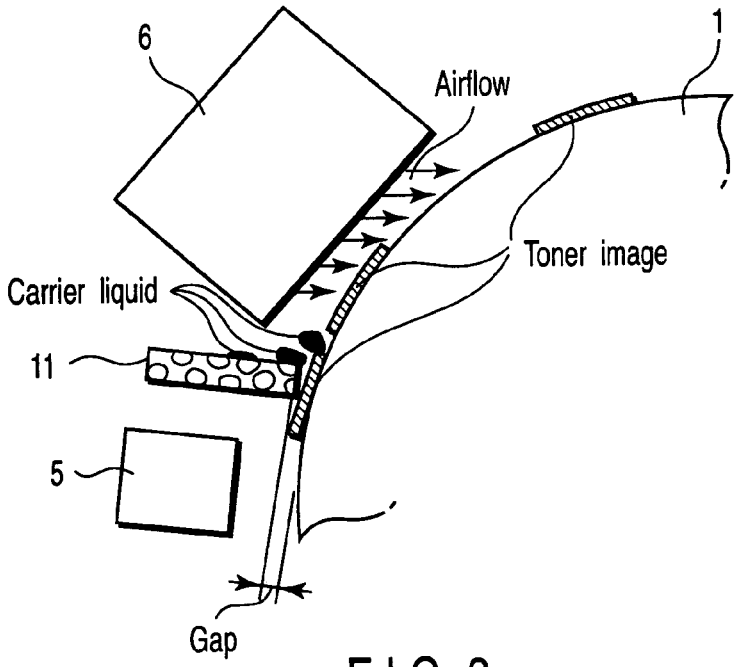
FIG. 3 is a schematic diagram showing one example of a liquid dripping (liquid droplet) resumption mechanism incorporated in the electrophotographic apparatus shown in FIG. 1.

As shown in FIG. 3, the shielding member 11 is formed, for example, into a plate shape by porous materials having absorbing properties, for example, bubble-containing elastic materials such as sponge and rubber, or sintered materials such as ceramics. The shielding member 11 is preferably provided with a length capable of shielding the liquid dripping in a total area of at least a length (width) of the photosensitive member 1 with respect to an axial direction of the photosensitive member 1.

As shown in FIG. 3, when the shielding member 11 is a plate-shaped member, a gap to be managed between a tip of the section and the photosensitive member 1 is kept at several hundreds of micrometers at maximum, preferably about 5 to 100 μm, more preferably 20 to 50 μm. When the shielding member 11 has a roller shape, a gap to be managed between a portion in the most vicinity of the photosensitive member 1 surface and the photosensitive member 1 is kept at several hundreds of micrometers at maximum, preferably about 5 to 100 μm, more preferably 20 to 50 μm.

The shielding member 11 is capable of momentarily absorbing the liquid dripping caused on the surface of the photosensitive member 1. Moreover, when the shielding member 11 is disposed in the vicinity of the drying unit 6, scattered droplets of the carrier liquid generated during conveyance into a drying step with the rotation of the photosensitive member 1 can be efficiently recovered, and the inside of the apparatus can be prevented from being polluted. Furthermore, when the shielding member 11 is disposed on a downstream side of the visible image stabilizing unit 5, and even when the carrier liquid flies/scatters, the scattered droplets can be inhibited from reaching the visible image stabilizing unit 5, whereby soil of the image can be prevented.

Figure 4:
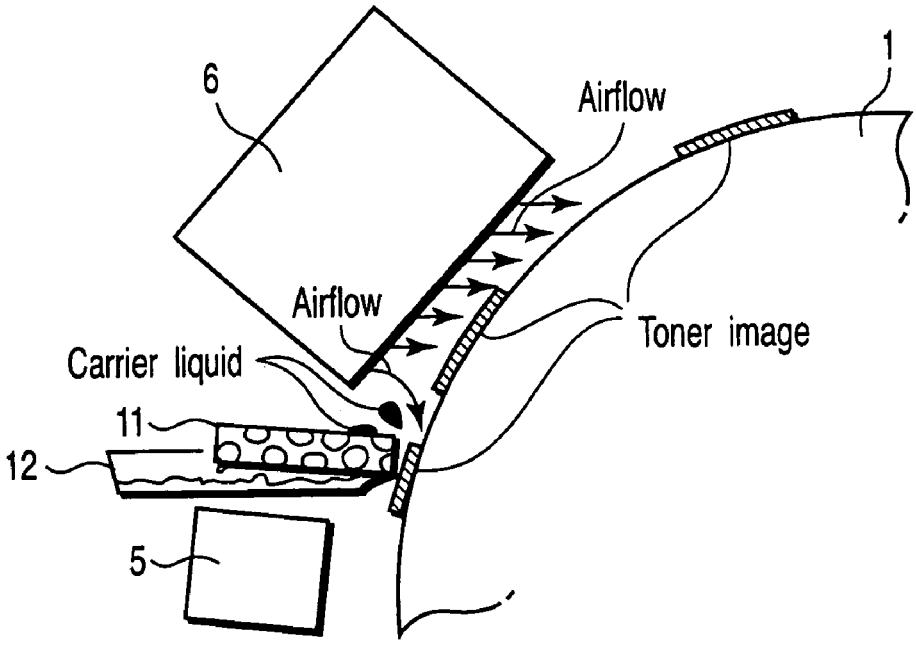
FIG. 4 is a schematic diagram showing another example of the liquid dripping (liquid droplet) resumption mechanism shown in FIG. 3.

For example, as shown in FIG. 4, the shielding member 11 may be provided with a resumption mechanism 12 which recovers the carrier liquid discharged from the porous member by suction means (not shown) for discharging the carrier liquid absorbed by the porous member to the outside of the porous member. The shielding member 11 shown in FIG. 3 is the porous member. Therefore, the carrier liquid cannot be absorbed any more in a case where the amount of the absorbed carrier liquid reaches a predetermined amount. To solve the problem, as shown in FIG. 4, the resumption mechanism 12 is disposed, the carrier liquid already absorbed in the porous member is discharged from the porous member, and recovered by the resumption mechanism 12, and accordingly the duration of the shielding capability can be extended greatly. It is to be noted that when the resumption mechanism 12 is constituted to include, for example, a detachably attached tank, the recovered carrier liquid is easily treated (discarded).

Moreover, when the absorbing member, that is, the porous member is formed into the plate shape as shown in FIG. 4, there are advantages that the constitution is simple and installation space can be saved.

Figure 5:
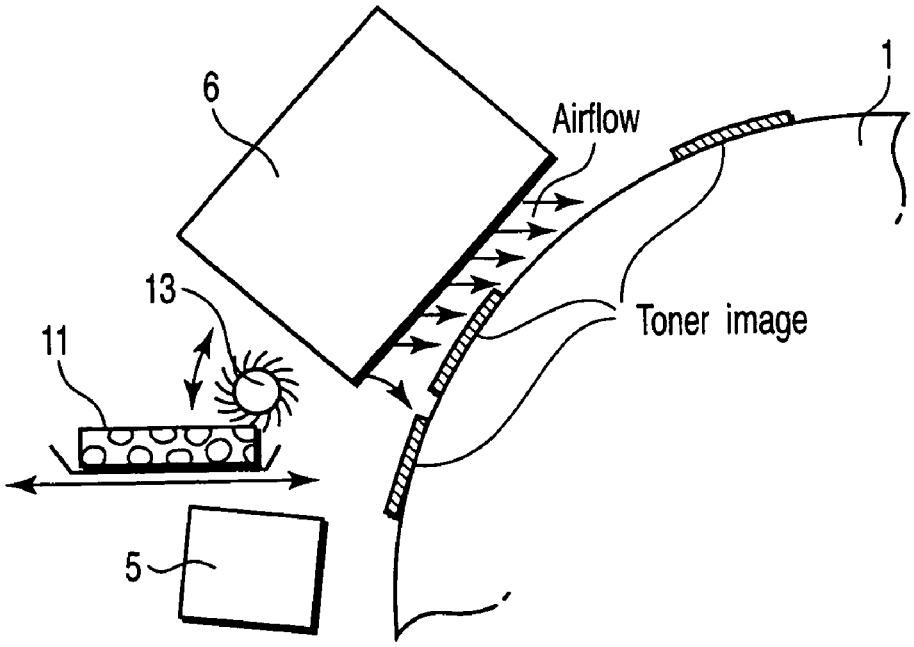
FIG. 5 is a schematic diagram showing still another example of the liquid dripping (liquid droplet) resumption mechanism shown in FIG. 3.

When the plate-shaped porous member is used as the shielding member 11, for example, a thickness is increased, and accordingly an amount of temporarily retainable carrier liquid can be increased. However, since a surface facing the photosensitive member 1 is fixed, clogging is caused after continuous use for a long time, and there is a possibility that a suction capability drops. To prevent this, for example, as shown in FIG. 5, the shielding member may be detached from the vicinity of the photosensitive member 1 at a time when any image is not formed, and may be cleaned by a cleaning mechanism 13 such as a roller or a brush.

Figure 6:
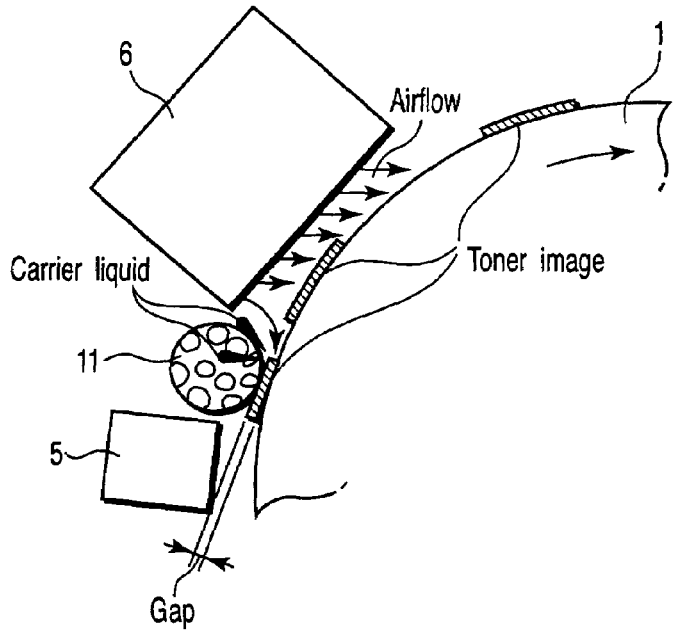
FIG. 6 is a schematic diagram showing still another example of the liquid dripping (liquid droplet) resumption mechanism shown in FIG. 3.

For example, as shown in FIG. 6, the shielding member 11 may be a roller-shaped member having the absorbing property. When the shielding member 11 has the roller shape, a gap between a portion in the most vicinity of the photosensitive member 1 surface and the photosensitive member 1 is kept at several hundreds of micrometers at maximum, preferably about 5 to 100 μm, more preferably 20 to 50 μm.

when the porous member is formed into the roller shape, for example, the clogging with the toner particles contained in the carrier liquid is reduced as compared with the use of the plate-shaped member shown in FIG. 4. Therefore, demands for the cleaning of the roller surface can be reduced. By the use of the roller member, an area opposite to the photosensitive member 1 can be enlarged, and the carrier liquid shielding capability is enhanced compared with the use of the plate-shape porous member.

Figure 7:
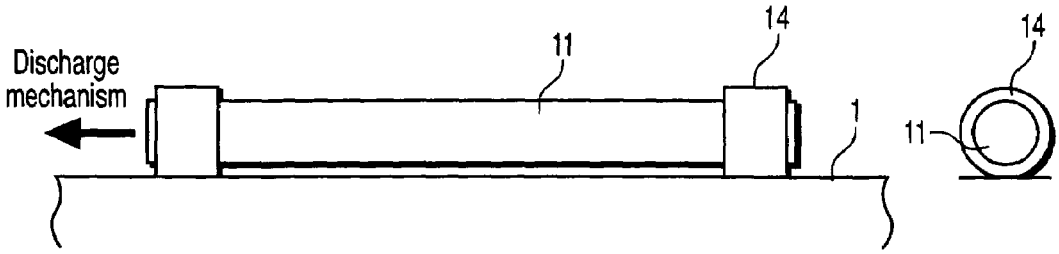
FIG. 7 is a schematic diagram showing one example of a roller member usable in the liquid dripping (liquid droplet) resumption mechanism shown in FIG. 6.

If the porous member is formed into the roller shape, as shown in FIG. 7, It is possible to dispose gap rings 14 on both ends of the porous roller. Accordingly, the gap between the roller member (shielding member) and the surface of the photosensitive member 1 can be easily maintained.

Moreover, for example, each gap ring 14 is constituted to contain a bearing, or the gap ring 14 is formed of a material having a small coefficient of friction, and used also as the bearing. Accordingly, a rotary force from a rotating/driving source (not shown) is supplied to the roller member, and the roller member can be rotated at a predetermined speed. In this case, the portion of the roller member opposite to the photosensitive member 1 can be continuously changed, and occurrence of a disadvantage that the carrier liquid solidifies in a specific portion of the roller member can be reduced.

Figure 8:
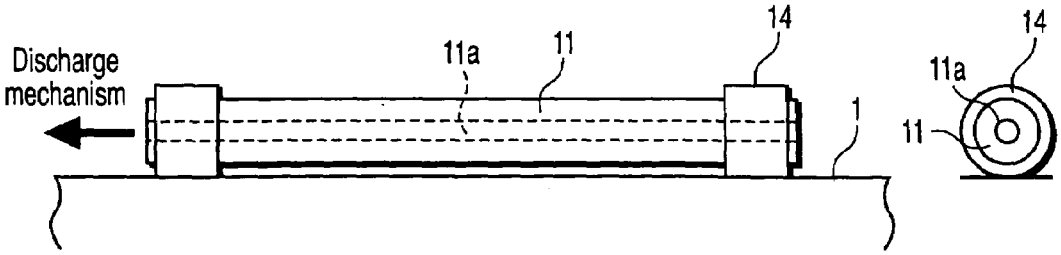
FIG. 8 is a schematic diagram showing another example of the roller member usable in the liquid dripping (liquid droplet) resumption mechanism shown in FIG. 6.

For example, as shown in FIG. 8, the shielding member 11 may be a roller member in which a guide path 11*a* to guide the absorbed carrier liquid is integrally formed.

As shown in FIG. 8, when the guide path 11*a* for conveying the carrier liquid is disposed inside the roller-shaped porous member, for example, the size of the resumption mechanism 12 described above with reference to FIG. 4 can be reduced. When the resumption mechanism 12 includes a recovery tank, a position of the tank can be set to an arbitrary position inside the apparatus.

Figure 9:
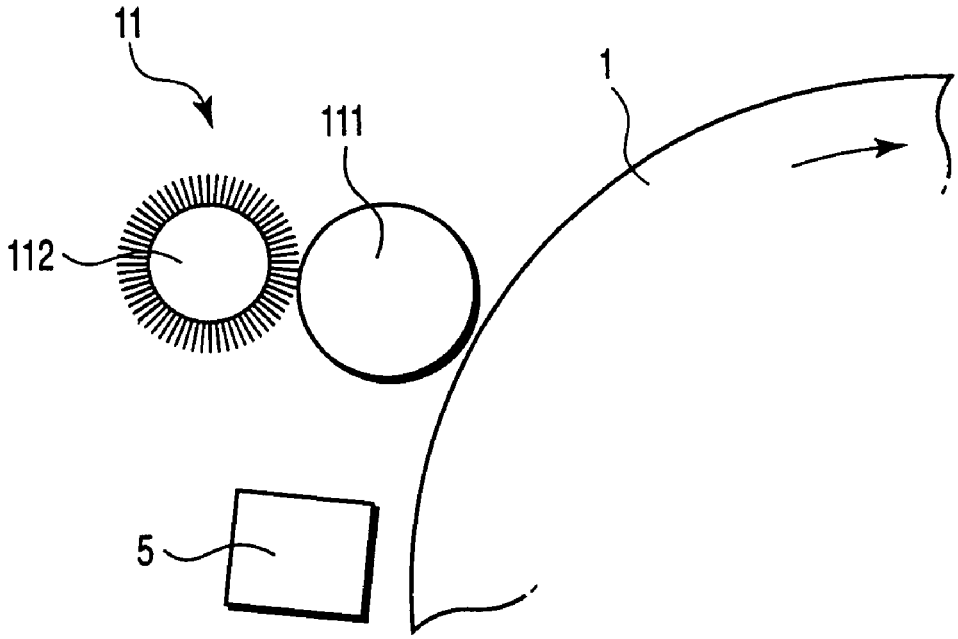
FIG. 9 is a schematic diagram showing another example of the liquid dripping (liquid droplet) resumption mechanism shown in FIG. 3.

As shown in FIG. 9, the shielding member 11 may comprise, a carrier liquid absorbing roller 111 obtained by forming, for example, the carrier liquid absorbing porous member shown in FIG. 6 into the roller shape; and a cleaning mechanism 112 which removes deposits (floating toner, paper powder, etc.) attached to the absorbing roller 111 together with the carrier liquid.

For example, a brush roller having a brush contacting with the outer peripheral surface of the absorbing roller 111 at a predetermined pressure is usable as the cleaning mechanism 112. For example, the brush roller 112 is rotated at high speed, and the deposits on the absorbing roller 111 surface are dropped, and further recovered by a recovery device (not shown). Accordingly, the surface of the absorbing roller 111 can be prevented from being clogged, or the deposits and toner particles accumulated on the surface of the absorbing roller 111 can be prevented from being undesirably returned toward the photosensitive member 1.

Figure 10:
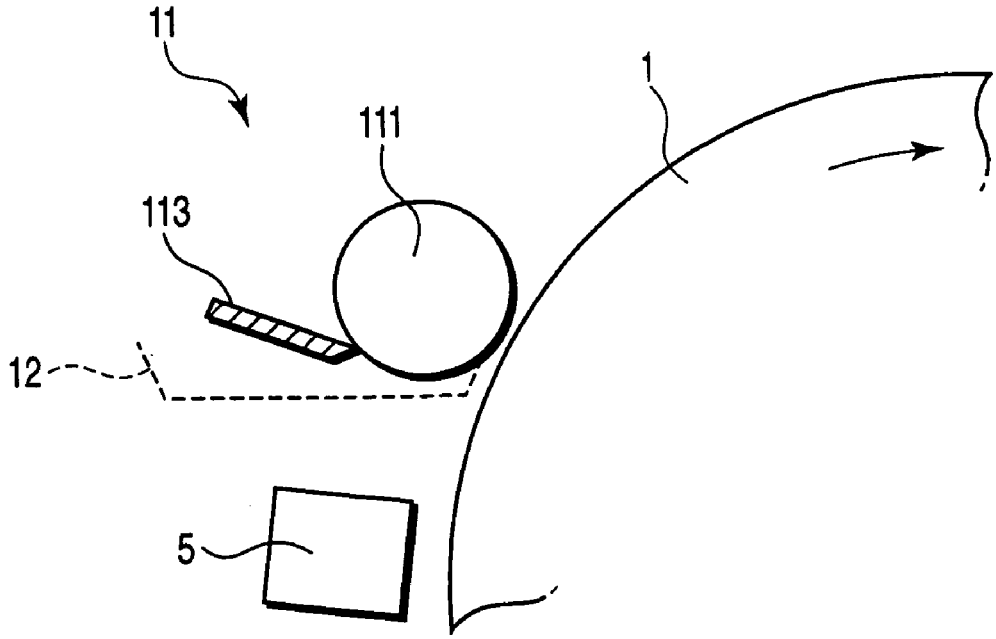
FIG. 10 is a schematic diagram showing one example of an image maintaining process in still another example of the liquid dripping (liquid droplet) resumption mechanism shown in FIG. 3.

As shown in FIG. 10, for example, the shielding member 11 may comprise, a carrier liquid absorbing roller 111 obtained by forming, for example, the carrier liquid absorbing porous member shown in FIG. 6 into the roller shape; and a carrier liquid removal mechanism 113 which is brought into contact with the absorbing roller 111 at a predetermined pressure and which accordingly discharges the carrier liquid absorbed by the absorbing roller 111 from the porous member of the roller 111, and removes the deposits attached to the absorbing roller 111.

For example, a blade-shaped (plate-shaped) member, a metal roller, a metal mesh or the like is usable as the carrier liquid removal mechanism 113.

the carrier liquid removal mechanism 113 contacts with the absorbing roller 111 under the pressure, and is capable of accordingly squeezing/removing the absorbed carrier liquid together with the deposits attached to the absorbing roller 111 surface. For example, the discharge mechanism for discharging the carrier liquid absorbed by the shielding member 11 as shown by one example in FIG. 4 does not have to be especially disposed.

The present invention is not limited to the embodiments described above and can be modified in various manners without departing from the spirit and scope of the invention.

For example, the present invention can provide an image forming apparatus of a liquid process electrophotographic system comprises:

(1) a shielding member having an absorbing property in the vicinity of a photosensitive member upstream of a drying unit.

(2) The shielding member comprises a plate or a roller having the absorbing property.

(3) Moreover, the apparatus has a discharge mechanism which discharges liquid droplets absorbed so far or deposits attached to the photosensitive member surface to the outside of the shielding member, and a mechanism which cleans the absorbed liquid droplets accumulated on the shielding member or the deposits attached to the photosensitive member surface in order to prevent the absorbing power of the shielding member from being lowered by the liquid droplets absorbed by the shielding member or the deposits attached to the photosensitive member surface. Accordingly, image dirt, or flying/scattering of a developing liquid is prevented over a long time.

What is claimed is:

1. An image forming apparatus comprising:

a photosensitive member which holds an electrostatic latent image:

a developing unit which supplies a liquid developer obtained by dispersing a toner in a carrier liquid to the electrostatic latent image to form a visible image on the photosensitive member;

a transfer member onto which the visible image is transferred;

an image stabilizing unit which applies an electric field to the visible image to enhance adsorption among the toners forming the visible image and between the toners and the photosensitive member;

a drying unit which blows an air current to the visible image having the adsorption to the photosensitive member enhanced by the image stabilizing unit to dry and remove the carrier liquid; and a shielding member which is disposed between the drying unit and the image stabilizing unit and which inhibits liquid droplets of the carrier liquid flowing backwards toward the image stabilizing unit from the drying unit from reaching the image stabilizing unit, wherein the shielding member is a plate-shaped member which absorbs the droplets.

2. An image forming apparatus comprising:

a photosensitive member which holds an electrostatic latent image;

a developing unit which supplies a liquid developer obtained by dispersing a toner in a carrier liquid to the electrostatic latent image to form a visible image on the photosensitive member;

a transfer member onto which the visible image is transferred;

an image stabilizing unit which applies an electric field to the visible image to enhance adsorption among the toners forming the visible image and between the toners and the photosensitive member;

a drying unit which blows an air current to the visible image having the adsorption to the photosensitive member enhanced by the image stabilizing unit to dry and remove the carrier liquid; and a shielding member which is disposed between the drying unit and the image stabilizing unit and which inhibits liquid droplets of the carrier liquid flowing backwards toward the image stabilizing unit from the drying unit from reaching the image stabilizing unit, wherein the shielding member is a roller which absorbs the droplets.

3. An image forming apparatus comprising:

a photosensitive member which holds an electrostatic latent image;

a developing unit which supplies a liquid developer obtained by dispersing a toner in a carrier liquid to the electrostatic latent image to form a visible image on the photosensitive member;

a transfer member onto which the visible image is transferred;

an image stabilizing unit which applies an electric field to the visible image to enhance adsorption among the toners forming the visible image and between the toners and the photosensitive member;

a drying unit which blows an air current to the visible image having the adsorption to the photosensitive member enhanced by the image stabilizing unit to dry and remove the carrier liquid; and a shielding member which is disposed between the drying unit and the image stabilizing unit and which inhibits liquid droplets of the carrier liquid flowing backwards toward the image stabilizing unit from the drying unit from reaching the image stabilizing unit, wherein the shielding member is a porous member which absorbs the droplets.

4. An image forming apparatus comprising:

a photosensitive member which holds an electrostatic latent image;

a developing unit which supplies a liquid developer obtained by dispersing a toner in a carrier liquid to the electrostatic latent image to form a visible image on the photosensitive member;

a transfer member onto which the visible image is transferred;

an image stabilizing unit which applies an electric field to the visible image to enhance adsorption among the toners forming the visible image and between the toners and the photosensitive member;

a drying unit which blows an air current to the visible image having the adsorption to the photosensitive member enhanced by the image stabilizing unit to dry and remove the carrier liquid;

a shielding member which is disposed between the drying unit and the image stabilizing unit and which inhibits liquid droplets of the carrier liquid flowing backwards toward the image stabilizing unit from the drying unit from reaching the image stabilizing unit; and a cleaning unit which cleans the shielding member.

5. The apparatus according to claim 4, wherein the shielding member is a plate-shaped member which absorbs the droplets.

6. The apparatus according to claim 4, wherein the shielding member is a roller which absorbs the droplets.

7. The apparatus according to claim 4, wherein the shielding member is a roller.

8. An image forming apparatus using a liquid developer comprising:

a photosensitive member which holds an electrostatic latent image;

a developing unit which supplies a liquid developer obtained by dispersing a toner in a carrier liquid to the electrostatic latent image to form a visible image on the photosensitive member;

a transfer member onto which the visible image on the photosensitive member is transferred;

a blowing mechanism which blows an air current having a predetermined speed with respect to the photosensitive member in a region along an outer peripheral surface of the photosensitive member between the developing unit and the transfer member;

an image stabilizing mechanism which applies an electric field to enhance adsorption among the toners constituting the visible image on the photosensitive member and between the toners and the photosensitive member;

a shielding member which is disposed between the blowing mechanism and the image stabilizing mechanism and which prevents liquid droplets of the carrier liquid flowing backwards toward the image stabilizing mechanism from the blowing mechanism from reaching the image stabilizing mechanism; and a liquid droplet resumption mechanism which recovers the carrier liquid shielded by the shielding member.

9. The apparatus according to claim 8, wherein the shielding member is positioned on an upstream side with respect to a direction of the air current supplied to the photosensitive member by the blowing mechanism.

10. An image forming method comprising:

forming an electrostatic latent image on a photosensitive member;

selectively supplying a liquid developer obtained by dispersing a toner in a carrier liquid to the formed electrostatic latent image to form a visible image on the photosensitive member;

applying an electric field to the visible image formed on the photosensitive member in such a manner that an electrostatic force is exerted on the toner forming the visible image on the side of the photosensitive member;

blowing an air current having a predetermined speed to the carrier liquid remaining together with the visible image on the photosensitive member to remove the carrier liquid; and recovering scattered droplets generated by the carrier liquids flying/scattering from the surface of the photosensitive member by a recovery member constituted of a porous member which absorbs the droplets.

* * * * *